US007927714B2

(12) United States Patent
Carter et al.

(10) Patent No.: US 7,927,714 B2
(45) Date of Patent: Apr. 19, 2011

(54) BARIUM-DOPED BOND COAT FOR THERMAL BARRIER COATINGS

(75) Inventors: Emily A. Carter, Belle Mead, NJ (US); Ivan Milas, Summit, NJ (US)

(73) Assignee: The Trustees of Princeton University, Princeton, NJ (US)

( * ) Notice: Subject to any disclaimer, the term of this patent is extended or adjusted under 35 U.S.C. 154(b) by 161 days.

(21) Appl. No.: 12/194,813

(22) Filed: Aug. 20, 2008

(65) Prior Publication Data

US 2010/0047615 A1 Feb. 25, 2010

(51) Int. Cl.
*B32B 15/04* (2006.01)
*B32B 18/00* (2006.01)
*B05D 3/02* (2006.01)

(52) U.S. Cl. ..... 428/629; 428/650; 428/653; 428/678; 428/680; 428/681; 427/383.7; 416/241 R; 416/241 B

(58) Field of Classification Search ..... None
See application file for complete search history.

(56) References Cited

U.S. PATENT DOCUMENTS 5,788,823 A 8/1998 Warnes et al.
5,824,423 A 10/1998 Maxwell et al.
5,900,326 A 5/1999 Bornstein et al.
5,985,470 A 11/1999 Spitsberg et al.
6,025,078 A 2/2000 Rickerby et al.
6,129,991 A * 10/2000 Warnes et al. ..... 428/610
6,132,520 A * 10/2000 Schilbe et al. ..... 134/2
6,136,451 A * 10/2000 Warnes et al. ..... 428/610
6,177,200 B1 1/2001 Maloney
6,254,935 B1 7/2001 Eaton et al.
6,284,323 B1 9/2001 Maloney
6,287,644 B1 9/2001 Jackson et al.
6,391,475 B1 * 5/2002 Spitsberg et al. ..... 428/652
6,458,473 B1 10/2002 Conner et al.
6,548,190 B2 4/2003 Spitsberg et al.
6,974,637 B2 12/2005 Pfaendtner et al.
6,979,498 B2 12/2005 Darolia et al.
7,172,820 B2 2/2007 Darolia et al.
7,226,668 B2 6/2007 Nagaraj et al.
7,338,719 B2 * 3/2008 Quadakkers et al. ..... 428/680
7,378,159 B2 5/2008 Gorman et al.

(Continued)

FOREIGN PATENT DOCUMENTS

EP 1008672 A1 6/2000

(Continued)

OTHER PUBLICATIONS

Coble, R. L., "A Model for Boundary Diffusion Controlled Creep in Polycrystalline Materials", Journal of Applied Physics, Jun. 1963, vol. 34, No. 6, pp. 1679-1682.

(Continued)

*Primary Examiner* — Aaron Austin
(74) *Attorney, Agent, or Firm* — Volpe and Koenig, P.C.

(57) ABSTRACT

A metallic article for high temperature applications such as a turbine engine component is protected by a thermal barrier coating system on the article's metallic substrate. The thermal barrier coating system includes a bond coat layer of aluminum containing alloy on the metal substrate, an alumina layer on the bond coat layer and a ceramic thermal barrier layer on the alumina layer. The bond coat layer is doped with elemental barium that enhances the creep resistance of the alumina layer, thus, minimizing spallation of the ceramic thermal barrier layer.

15 Claims, 1 Drawing Sheet

U.S. PATENT DOCUMENTS

| | | | | |
|---|---|---|---|---|
| 2007/0044869 | A1 | 3/2007 | Darolia et al. | |
| 2007/0160859 | A1 * | 7/2007 | Darolia et al. | 428/469 |

FOREIGN PATENT DOCUMENTS

| | | | |
|---|---|---|---|
| EP | 0780484 | B1 | 9/2001 |
| EP | 1295965 | A2 | 3/2003 |
| EP | 1806434 | A1 | 7/2007 |

OTHER PUBLICATIONS

Haynes, J. A., Ferber, M. K., Porter, W. D., Rigney E. D., Characterization of Alumina Scales Formed During Isothermal and Cyclic Oxidation of Plasma-Sprayed TBC Systems at 1150° C., Oxidation of Metals, 1999, vol. 52, Nos. 112, pp. 31-76.

Langdon, T. G., "Grain boundary sliding revisited: Developments in sliding over four decades", J Mater Sci 41, 2006, pp. 597-609.

Pint, B. A., Hobbs; L. W., "The Formation of a-A12O3 Scales at 1500° C.", 1994, Oxidation of Metals, 1994, vol. 41, Nos. 3/4, pp. 203-233.

Kottada, R. S., Chokshi, A. H., "The High Temperature Tensile and Compressive Deformation Characteristics of Magnesia Doped Alumina", Acta Metallurgica, 2000, vol. 48, pp. 3905-3915.

Matsunaga, K. Nishimura, H., Muto, H., Yamamoto, T., Ikuhara, Y., "Direct measurements of grain boundary sliding in yttrium-doped alumina bicrystals", Applied Physics Letters, Feb. 24, 2003, vol. 82, No. 8, pp. 1179-1181.

Chokshi, A. H., "An evaluation of the grain-boundry sliding contribution to creep deformation in polycrystalline alumina", J Mater Sci 25, 1990, pp. 3221-3228.

Veal, B. W., Paulikas A. P., Hou, P. Y., "Creep in protective a-A12O3 thermally grown on B-NiAl", Applied Physics Letters, 2007, vol. 90:121914.

Nakamura K., Mizolguchi T., Shibata, N., Matsunaga, K., Yamamoto, T., Ikuhara, Y., "First-principles study of grain boundary sliding in a-A12O3", 2007, Physical Review B 75:184109.

Hohenberg, P., Kohn, W., "Inhomogeneous Electron Gas", Physical Review, Nov. 9, 1964, vol. 136, No. 3B, pp. B864-871.

Kohn, W., Sham, L. J., "Self-Consistent Equations Including Exchange and Correlation Effects", Physical Review, Nov. 15, 1965, vol. 140, No. 4A, pp. A1133-1138.

Kresse G., Hafner, J., "Ab initio molecular dynamics for open-shell transition metals", Physical Review B, Nov. 1, 1993, vol. 48, No. 17, pp. 13115-13118.

Kresse, G., Fürthmuller, J., "Efficient iterative schemes for ab initio total-energy calculations using a plane-wave basis set", Physical Review B, vol. 54, No. 16, pp. 11169-11186.

Kresse, G., Fürthmuller, J., "Efficiency of ab-initio total energy calculations for metals and semiconductors using a plane-wave basis set", 1996, Computational Materials Science, vol. 6, pp. 15-50.

Blöchl, P. E., "Projector augmented-wave method", Dec. 15, 1994, Physical Review B, vol. 50, No. 24, pp. 17953-17979.

Kresse, G., Joubert D., "From ultrasoft pseudopotentials to the projector augmented-wave method", Jan. 15, 1999, Physical Review B., vol. 59, No. 3, pp. 1758-1775.

Perdew, J. P., Burke, K., Ernzerhof, M., "Generalized Gradient Approximation Made Simple", Physical Review Letters, Oct. 28, 1996, vol. 77, No. 18, pp. 3865-3868.

Monkhorst, H. J., Pack, J., D., "Special points for Brillouin-zone integrations", Physical Review B., Jun. 15, 1976, vol. 13, No. 12, pp. 5188-5192.

Hinnemann, B., Carter, E. A., "Adsorption of A1, O, Hf, Y, PT, and S Atoms on a-A12O3(0001)", J. Phys. Chem. C, 2007, vol. 111, pp. 7105-7126.

Milas, I., Hinnemann, B., Carter, E. A., "Structure of and ion segregation to an alumina grain boundary: Implications for growth and creep", J. Mater. Res., May 2008, vol. 23, No. 5, pp. 1494-1506.

Kenway, P.R., "Calculated Structures and Energies of Grain Boundaries in a-A13O3", J. Am. Ceram. Soc., 1994, vol. 77, pp. 349-355.

Cho, J., Wang, C. M., Chan, H. M., Rickman, J. M., Harmer, M. P., "Role of Segregating Dopants on the Improved Creep Resistance of Aluminum Oxide", Acta Mater, 1999, vol. 47, No. 15, pp. 4197-4207.

Molteni, C., Francis, G. P., Payne, M.C., Heine, V., "First Principles Simulation of Grain Boundary Sliding", Physical Review Letters, Feb. 19, 1996, vol. 76, No. 8, pp. 1284-1287.

Voytovych, R., MacLAREN, I., Gülgün, M. A., Cannon, R. M., Rühle, M., "The effect of yttrium on densification and grain growth in a-alumina", Acta Materialia, 2002, vol. 50, pp. 3453-3463.

Wang, C. M., Cargill III, G. S., Chan, H. M., Harmer, M. P., "Structural Features of Y-Saturated and Supersaturated Grain Boundaries in Alumina", Acta Materialia, 2000, vol. 48, pp. 2579-2591.

* cited by examiner

BARIUM-DOPED BOND COAT FOR THERMAL BARRIER COATINGS

GOVERNMENTAL INTEREST

This invention was made with government support under contract FA9550-07-1-0063 awarded by USAR/AFOSR. The Government has certain rights in the invention.

FIELD OF THE INVENTION

This disclosure is generally related to a thermal barrier coating applied to the surface of a superalloy article such as a gas turbine engine turbine blade, and to a method of applying the thermal barrier coating.

BACKGROUND

Superalloys of nickel, cobalt or nickel-iron base alloying element are often used in extreme heat and corrosive environments such as the turbine blades and vanes of a gas turbine engine. To protect the superalloy components from the heat, oxidation and corrosion effects of the impinging hot gas stream, the superalloy components are protected by thermal barrier coating (TBC) systems. A typical TBC system has a three-layer structure where an outer coat of ceramic layer provides the thermal protection. The ceramic layer is typically a yttria-stabilized zirconia (YSZ). A thin metallic layer or bond coat layer is applied under the ceramic layer to provide adhesion between the ceramic layer and the superalloy substrate. The metallic bond coat layer is generally aluminum based alloy such as nickel aluminide, cobalt aluminide or platinum aluminide. Subsequently, a layer of aluminum oxide scale is thermally grown at the interface between the metallic bond coat layer and the ceramic layer. The metallic bond coat layer serves as an aluminum reservoir for the formation of the adherent aluminum oxide scale layer. This thermally grown aluminum oxide scale protects the superalloy substrate from oxidative corrosion. Oxygen readily diffuses through the YSZ ceramic layer and the aluminum oxide resists the oxidizing effects of the hot combustion gas stream.

Unfortunately, the coefficient of thermal expansion (CTE) of alumina is considerably lower than that of the underlying superalloy metal substrate. Upon thermal cycling of the superalloy components, the CTE mismatch causes stress to accumulate in the growing oxide layer. Once the thickness of the oxide reaches a critical value (around 10 μm), the stresses become so large that they must be alleviated by either creep or plastic deformation, which leads to spalling of the coating layers and failure of the TBC system. Thus, slowing the oxide growth and/or increasing its creep resistance are ways to extend the life of the TBC system.

SUMMARY

According to an embodiment of the present disclosure, a thermal barrier coating system for coating a metallic substrate is disclosed wherein a significant improvement in spalling resistance for the ceramic layer is achieved by doping the bond coat layer to include elemental barium. The thermal barrier coating system comprises a bond coat layer on the metallic substrate, the bond coat layer comprising an aluminum containing alloy and a doping material that comprises elemental barium. An aluminum oxide layer is provided on the bond coat layer and a ceramic thermal barrier layer is provided on the aluminum oxide layer.

According to another embodiment, a metallic article comprises a metallic substrate, the metallic substrate comprising a superalloy, and a thermal barrier coating system on the metallic substrate. The thermal barrier coating system comprises a bond coat layer on the metallic substrate. The bond coat comprises an aluminum containing alloy and a doping material comprising elemental barium in the amount of about 0.01 to about 5.0% by weight. An aluminum oxide layer is provided on the bond coat and a ceramic thermal barrier layer is provided on the aluminum oxide layer.

According to another implementation of the present disclosure, a method of applying a thermal barrier coating on a metallic substrate comprises forming a bond coating on the metallic substrate, the bond coat comprising an aluminum containing alloy and a doping material comprising elemental barium, applying a ceramic thermal barrier layer to the bond coating; and thermally growing an aluminum oxide layer between the bond coat and the ceramic thermal barrier layer.

The addition of elemental barium in the bond coat layer substantially improves the creep resistance property of the aluminum oxide layer by diffusing into the aluminum oxide layer and segregating to the alumina grain boundaries.

Figure 1:
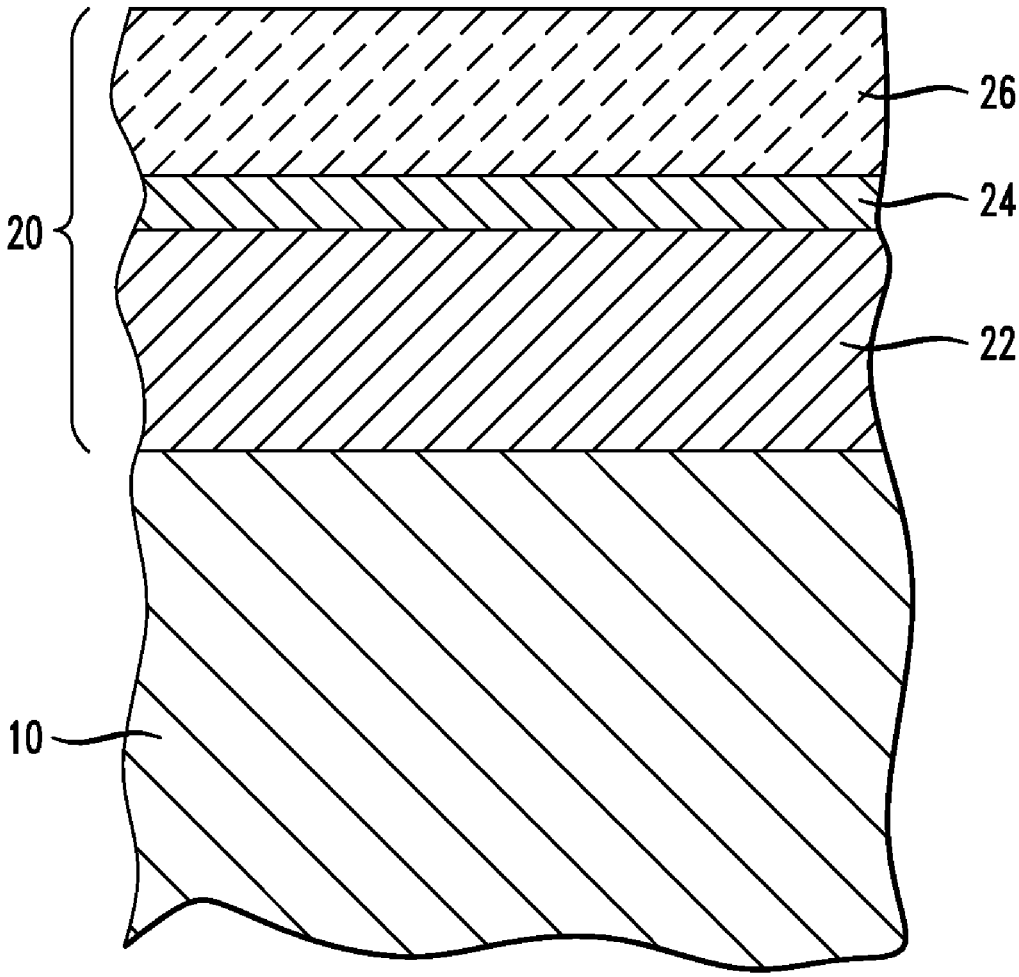
FIG. 1. is a schematic illustration of a cross-sectional view of a metallic article having a thermal barrier coating according to the present disclosure.

The drawing is schematic and the structures rendered therein are not intended to be in scale. The embodiments of this disclosure are described below with reference to the above drawing.

DETAILED DESCRIPTION

FIG. 1 is an illustration is a cross-sectional view of a portion of a metallic article showing the thermal barrier coating (TBC) system 20 provided on a surface of a metallic substrate portion 10 of the metallic article according to an embodiment of the present disclosure. The metallic article may comprise a superalloy of nickel, cobalt or nickel-iron base. The TBC system 20 comprises a bond coat layer 22 on the surface of the superalloy substrate 10, a thermally grown oxide layer 24 on the bond coat layer 22 and a ceramic thermal barrier coat layer 26 on the oxide layer 24.

The bond coat layer 22 may be comprised of an aluminum containing alloy having an MCrAlY or MAlY compositions, where "M" may be selected from the group consisting of iron, cobalt, nickel, platinum and mixtures thereof. The "Y" may be one or more of yttrium, hafnium, lanthanum, cerium and scandium.

According to an embodiment, the bond coat layer 22 contains a small amount of elemental barium in the amount of about 0.01 to about 5.0% by weight. We have found that the doping of the metallic bond coat layer with elemental barium increases the activation energy of grain boundary sliding in alumina surprisingly more than any of the conventionally used transition metal dopants. This means that larger stresses are needed for grain boundary sliding so the rate of grain boundary sliding and, in turn, the creep rate decreases. A decrease in the creep rate strengthens the alumina layer 24 and extends its time to spallation.

The bond coat layer 22 may be applied or otherwise formed on the metal substrate 10 by any of a variety of conventional techniques. For example, the bond coat layer 22 may be applied by a physical vapor deposition, electron beam deposition, plasma spray, or other thermal spray deposition methods such as high velocity oxy-fuel spray, chemical vapor deposition, or a combination of such techniques. Typically, the deposited bond coat layer 22 has a thickness of about 1 to about 19.5 mils.

The ceramic thermal barrier coat layer 26 may be applied or otherwise formed on the alumina layer 24 by any of a variety of conventional techniques, such as those used for the bond coat layer 22. For example, the thermal barrier coat layer 26 may be applied using a physical vapor deposition, electron beam deposition, plasma spray, or other thermal spray deposition methods such as high velocity oxy-fuel spray, chemical vapor deposition, or a combination of such techniques. The thickness of the thermal barrier coat layer 26 is typically from about 1 to about 100 mils (from about 25.4 to about 2540 microns) and will depend upon a variety of factors, including the operational environmental condition of the metal article 10 that is involved.

The ceramic thermal barrier coat layer 26 may be comprised of those materials that are capable of reducing heat flow to the underlying superalloy metal substrate 10. These materials usually have a melting point of at least about 2000° F. typically at least about 2200° F., and more typically in the range of from about 2200° F. to about 3500° F. Suitable materials for the ceramic thermal barrier coat layer 26 include various zirconias, chemically stabilized zirconias (i.e., various metal oxides such as yttrium oxides blended with zirconia), such as yttria-stabilized zirconias, ceria-stabilized zirconias, calcia-stabilized zirconias, scandia-stabilized zirconias, magnesia-stabilized zirconias, india-stabilized zirconias, ytterbia-stabilized zirconias as well as mixtures of such stabilized zirconias and some incidental impurities. The ceria, india, magnesia, scandia, yttria or ytterbia is added to the zirconia to stabilize the zirconia in the tetragonal/cubic crystal structure.

During manufacture of the superalloy article, after the thermal barrier coat layer 26 is formed on the bond coat layer 22, the system is thermally cycled which results in a thin layer of alumina forming between the bond coat and the thermal barrier coat layer 26. The alumina layer 24 may comprise alumina and may also include other oxides. The elemental barium from the bulk bond coat layer 22 then diffuses into the alumina layer 24 and segregates to alumina grain boundaries. Conventionally, transition metals such as yttrium, hafnium, lanthanum, cerium and scandium are added to the bond coat layer 22 to strengthen the alumina layer 24 and lower its growth rate. The conventional transition metal dopants also tend to inhibit the diffusion creep of the alumina layer because the oxide growth and diffusion creep occur by mechanistically similar processes.

However, the inventors have found that the presence of elemental barium in the alumina grain boundaries significantly enhances the overall creep resistance of the alumina layer 24 well beyond the enhancement achieved by the conventional doping materials. The inventors have found that the presence of barium in the alumina grain boundary increases the grain boundary sliding activation energy in alumina substantially more than any of the conventional transition metal dopants. The inventors believe that because creep occurs through a combination of both mechanisms: 1) diffusion and 2) grain boundary sliding, the increase in the grain boundary sliding activation energy resulting from the presence of elemental barium substantially improves the overall creep resistance of the alumina layer.

The TBC system 20 of the present disclosure may be useful with a variety of turbine engine parts and components that are formed from metal substrates comprising metals, metal alloys, including superalloys that are used in operational conditions exposing the components to high temperatures that occur during normal turbine engine operation.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

One or more features from any embodiment may be combined with one or more features of any other embodiment without departing from the scope of the invention. A recitation of "a", "an" or "the" in the above description is intended to mean "one or more" unless specifically indicated to the contrary.

What is claimed is:

1. A thermal barrier coating system for a metallic substrate, the coating system comprising:
- a bond coat layer on the metallic substrate, the bond coat layer comprising an aluminum containing alloy and a doping material comprising elemental barium;
- an aluminum oxide layer on the bond coat layer; and
- a ceramic thermal barrier layer on the aluminum oxide layer.

2. The thermal barrier coating system of claim 1, wherein the elemental barium is present in the bond coat layer in the amount of about 0.01 to about 5.0% by weight.

3. The thermal barrier coating system of claim 1, wherein the metallic substrate comprises a nickel based superalloy.

4. The thermal barrier coating system of claim 1, wherein the metallic substrate comprises a cobalt based superalloy.

5. The thermal barrier coating system of claim 1, wherein the metallic substrate comprises a nickel-iron based superalloy.

6. The thermal barrier coating system of claim 1, wherein the aluminum containing alloy comprises one of a nickel aluminide, a cobalt aluminide, a platinum aluminide and an MCrAlY alloy, wherein the M in MCrAlY is selected from a group consisting of iron, cobalt, nickel, platinum and mixtures thereof and the Y in MCrAlY alloy is at least one of yttrium, hafnium, lanthanum, cerium and scandium.

7. A metallic article comprising:
- a metallic substrate comprising a superalloy; and
- a thermal barrier coating system on the metallic substrate, the coating system comprising:
  - a bond coat layer on the metallic substrate, the bond coat comprising an aluminum containing alloy and a doping material comprising elemental barium;
  - an aluminum oxide layer on the bond coat; and
  - a ceramic thermal barrier layer on the aluminum oxide layer.

8. The metallic article of claim 7, wherein the elemental barium is present in the bond coat layer in the amount of about 0.01 to about 5.0% by weight.

9. The metallic article of claim 7, wherein the superalloy comprises a nickel based superalloy.

10. The metallic article of claim 7, wherein the superalloy comprises a cobalt based superalloy.

11. The metallic article of claim 7, wherein the superalloy comprises a nickel-iron based superalloy.

12. The metallic article of claim 7, wherein the aluminum containing alloy comprises one of a nickel aluminide, a cobalt aluminide, a platinum aluminide and an MCrAlY alloy, wherein the M in MCrAlY is selected from a group consisting of iron, cobalt, nickel, platinum and mixtures thereof and the Y in MCrAlY alloy is at least one of yttrium, hafnium, lanthanum, cerium and scandium.

13. A method of applying a thermal barrier coating on a metallic substrate, comprising:
- forming a bond coating on the metallic substrate, wherein the bond coat comprises an aluminum containing alloy and a doping material comprising elemental barium;
- applying a ceramic thermal barrier layer to the bond coating; and thermally growing an aluminum oxide layer between the bond coat and the ceramic thermal barrier layer.

14. The method of claim 13, wherein the elemental barium is present in the bond coat layer in the amount of about 0.01 to about 5.0% by weight.

15. The method of claim 13, wherein the aluminum containing alloy comprises one of a nickel aluminide, a cobalt aluminide, a platinum aluminide and an MCrAlY alloy, wherein the M in MCrAlY is selected from a group consisting of iron, cobalt, nickel, platinum and mixtures thereof and the Y in MCrAlY alloy is at least one of yttrium, hafnium, lanthanum, cerium and scandium.

* * * * *